US006425403B1

(12) United States Patent
Lin Lu et al.

(10) Patent No.: US 6,425,403 B1
(45) Date of Patent: Jul. 30, 2002

(54) HAIR DYEING PROCESS UTILIZING A HEAT APPLICATION DEVICE

(75) Inventors: Richard Chun Lin Lu; Charles Can Lin Wu; Mary Luo; Jack Zhang, all of Chino, CA (US)

(73) Assignee: Naturastar, Inc., Chino, CA (US)

( * ) Notice: Subject to any disclaimer, the term of this patent is extended or adjusted under 35 U.S.C. 154(b) by 0 days.

(21) Appl. No.: 09/569,013

(22) Filed: May 11, 2000

(51) Int. Cl.[7] ..... A61K 7/13; A45D 7/06; A45D 7/02; A45D 19/18

(52) U.S. Cl. ..... 132/208; 132/206; 132/211; 132/270

(58) Field of Search ..... 132/208, 200, 132/202, 206, 211, 207, 270, 271

(56) References Cited

U.S. PATENT DOCUMENTS 3,390,689 A * 7/1968 Newman ..... 132/208
3,746,015 A * 7/1973 Schulman ..... 132/208
4,165,754 A * 8/1979 Di Pasqua ..... 132/208
4,289,150 A * 9/1981 Kimball ..... 132/208
4,483,354 A * 11/1984 Marcotte ..... 132/208
5,024,244 A * 6/1991 Brown ..... 132/270
5,056,538 A * 10/1991 Matula ..... 132/208
5,146,937 A * 9/1992 Lefebvre ..... 132/208
5,224,964 A * 7/1993 Shami ..... 8/405
5,773,802 A * 6/1998 Graves ..... 219/759
6,022,380 A * 2/2000 Satoh ..... 8/405

* cited by examiner

*Primary Examiner*—John J. Wilson
*Assistant Examiner*—Robyn Kieu Doan
(74) *Attorney, Agent, or Firm*—Albert O. Cota

(57) ABSTRACT

A hair dyeing process which utilizes a hair dye in combination with a heat application means. By applying heat to a person's head, immediately after the dye has been applied, the hair can be quickly and efficiently dyed and hair damage is minimized. The heat application means (12) is disclosed in five designs: the first utilizes a conventional, hand-held, hot-air blower (14) in combination with a plastic head cap (18) such as a shower cap (20); the second utilizes the plastic head cap (16) having attached a light flexible hose (24) that is connected to a heat source (26); the third consists of a hot, moistened towel (32); the fourth consists of a corded, electric heating pad (40); the fifth consists of a cordless heating pad (42) that has inserted a multiplicity of heat absorbing elements (50). When the pad (42) is heated in a microwave oven the elements (50) allow the pad (42) to retain heat for an extended period of time.

6 Claims, 2 Drawing Sheets

HAIR DYEING PROCESS UTILIZING A HEAT APPLICATION DEVICE

TECHNICAL FIELD

The invention pertains to processes and devices for coloring hair and, more particularly to a hair color dyeing process which utilizes a heating device to reduce the time required to dye the hair.

BACKGROUND ART

Processes for applying color-altering materials, such as dyes, to hair for the purpose of temporarily or permanently changing hair color are well-known in prior art. Typically, the color of hair can be altered through the use of rinses, sprays, lotions or creams. When darkening hair, the coloring material usually taken the form of a dye. Regardless of the coloring material used, it is applied in a step-by-step manner, often requiring a long waiting period to allow the chemicals in the coloring material to react and for the materials to bond with the hair.

Hair that is dyed retains its color until the color is chemically removed by bleaching or other like processes. The hair dyeing process is typically conducted at alkaline pH 9 to 10, requires 20 to 40 minutes, and usually employs hydrogen peroxide as an oxidizer. Consumers generally have their hair dyed periodically, typically once a month, sometimes as often as twice a month.

It is well known that when hair is treated with peroxide or other oxidizers, an essential amino-acid called cystins, which is found in hair, undergoes oxidation to cysteric acid. This chemical reaction leads to a weakening of the hair structure, making the hair dryer and prone to breakage. Accordingly, there is reason for consumers to believe that exposure to hydrogen peroxide during the dyeing of hair is a primary causative factor responsible for damaging the hair.

Damage to hair after a single dye application from such compositions, may be small. However, when dye applications are repeated, or when combined with other cosmetic treatments, such as permanent waving, relaxing, or bleaching, hair damage can be considerably more severe. Such damage is normally experienced by the consumer in the form of dry and brittle hair which has a tendency to break-off.

The hair coloring industry has attempted to satisfy the consumer concern or reformulating hair dyes with a metal ion catalyst that hastens the peroxide oxidation reaction of the dye precursors. This reformulation reduces the amount of time hair is exposed to the damaging effects of hydrogen peroxide or other oxidizers. However, these catalytic oxidative dyeing processes have met with little or not commercial success.

Against this background of known technology, the applicants have developed a new, faster, more efficient, and cost-effective hair dyeing process which utilizes heat and that can be performed outside the confines of a hair salon.

A search of the prior art did not disclose any patents that read directly on the claims of the instant invention. However the following U.S. patents, which do not disclose a heat application means, are considered related:

| PATENT NO. | INVENTOR | ISSUED |
|---|---|---|
| 5,843,193 | Hawkins, et al | December 1, 1998 |
| 5,316,551 | Wenke | May 31, 1994 |
| 5,100,436 | Wenke | March 31,1992 |
| 4,935,032 | Grollier | June 19, 1990 |
| 4,279,613 | Konrad, et al | July 21, 1981 |

The U.S. Pat. No. 5,843,193 discloses a composition for oxidatively dyeing hair. The composition comprising, by weight of the total composition, 0.001–20% of at least one primary intermediate and at least one coupler for the formation of oxidation dyes, 0.01–10% of a 2-hydroxphenyl benzotriazole compound which absorbs ultraviolet radiation in the wavelength range of 0.5–20% surfactant, and 10–65% water; a two component kit containing the hair dye composition and a developer, and a process for oxidatively dyeing the hair for a time period ranging from 2 to 60 minutes.

The U.S. Pat. Nos. 5,316,551 and 5,100,438 patents disclose a method for oxidatively dyeing hair. A pretreatment consists of contacting hair with an aqueous solution of an effective amount of particular metal/chelate complexes, and is followed by a treatment with an oxidative dye mixture. The process serves to conform the oxidative dyeing rate of virgin hair to that of the normally noncongruent rate of nonvirgin hair, so as to enhance the efficiency of the oxidative dyeing process without reducing the intensity or variety of the color.

The U.S. Pat. No. 4,935,032 discloses a process for dyeing human hair. The process utilizes the steps of applying to hair a composition the temperature of which is higher than 30° C. and lower than 50° C. The application of heat increases the solubility of the nitro dyestuff in the composition. The composition contains at least one nitro dyestuff of the benzene series, supersaturated relative to its solubility limit at ambient temperature in a cosmetic medium suitable for dyeing heir. The composition is chosen from the dyestuffs having a ratio KC lim greater than 2 its aqueous solution. The KO lim is the ratio of the limiting concentrations of the dyestuff in an aqueous medium which are measured at 50° C. and 18° C. the composition is maintained in contact with the hair either at ambient temperature or at a temperature above room temperature and below 50° C.

The U.S. Pat. No. 4,279,613 discloses a hair coloring composition and a method for using the composition. The composition includes a coupler substance, customary couplers and a compound of the formula ##STR1##. The novel couplers are more physiologically suitable for use in hair colors and allow for the preparation of compositions which lead to highly stable colorings over a broad range of shades and tones. After the hair dye is applied the mixture is allowed to react for 30 minutes at 40° C.

For background purposes and as indicative of the art to which the invention is related, reference may be made to the remaining cited patents.

| PATENT NO. | INVENTOR | ISSUED |
|---|---|---|
| 5,002,075 | Kellett | March 26, 1991 |
| 4,470,826 | Bugauti, et al | September 11, 1984 |
| 4,206,195 | Bolich, Jr., et al | June 3, 1980 |

DISCLOSURE OF THE INVENTION

When dyeing the hair, in general, the longer the hair dyeing process takes, the greater the risk that the air will be damaged. Conversely, the shorter the time period the less risk there is that hair damage will occur.

Current hair dyeing processes are widely used for permanently coloring hair. They are simple and convenient to use, low cost and safe, but unfortunately, they are also relatively slow when compared to the hair dyeing process disclosed herein which utilizes heat to "speed up" the hair dyeing process. When heat is applied, the speed of the chemical reaction involved in the dyeing process is increased. The higher the temperature applied the quicker the chemical reaction which, in turn, minimizes hair damage.

The applied temperature functions by having a major effect on the dye reaction rate. Typically, for a common organic reaction when reactant concentrations are held constant, the rate nearly doubles with each rise in temperature of 10° C. In fact, for many reactions near room temperature, an increase of 10° C. causes a doubling or tripling of the rate. If concentration-time data is collected for the same reaction run at different temperatures, and the rate constant is solved, we find that k increases as the temperature (T) increases. In other words, temperature affects the rate by affecting the rate constant. A plot of k vs T gives a curve that increases exponentially, as shown in the Arrhenius Equation:

$$k=Ag^{-Ea/RT}$$

where k is the rate constant, e is the base of natural logarithms, T is the absolute temperature, and R is the universal gas constant. The Ea term is the activation energy of the reaction, which Arrhenius considered the minimum energy that molecules must have to react. This negative exponential relationship between temperature and the rate constant means that as the temperature increases, the negative exponent becomes smaller; and therefore the value of k becomes larger, which means that the rate increases:

Higher T→Larger k→increase rate.

The examples below are given to further illustrate the effect of temperature on the dyeing process. Two of the applicant's products and two products made by Clairol and L'Oreal were tested. For comparison purpose, a relative scale from 0 to 100 was used to quantify the intensity of the resulting color applied to the hair. The larger the number, the more intense the color.

EXAMPLE I

The following dye composition made by the applicant produces a brown-block color when applied to pre-bleached light-brown color hair:

| | |
|---|---|
| P-Phenylenediamine | 0.17% |
| M-phenylenediamine | 0.09% |
| Ethanolamine | 1.5% |
| Hydrogen peroxide | 3% |
| Surfactant | 2.5% |
| Resorcinol | 1.12% |
| Water | Q.S. 100% |

A specimen of pre-bleached, light-brown color hair was treated with the above-described dye composition for 5, 10, 15, 20, 25 and 30 minutes in different temperatures. For the test accuracy and consistency, the treated hair specimens were put in beakers which remained in a water bath in which the temperature was controlled at 20, 30 and 40° C. respectively. The test results for Example I follows:

| | time (minutes) | | | | | |
|---|---|---|---|---|---|---|
| | 5 min | 10 min | 15 min | 20 min | 25 min | 30 min |
| 20° C. color | 25 | 35 | 60 | 70 | 80 | 90 |
| 30° C. color | 50 | 80 | 90 | 95 | 100 | 100 |
| 40° C. color | 90 | 95 | 100 | 100 | 100 | 100 |

From the above data, it can be seen that a color intensity of 90 was attained in 30 minutes at 20° C. But the same color intensity of 90 was also reach in 15 minutes at 30° C. and in 5 minutes at 40° C.

In a temperature test, at an ambient temperature of 22° C., the average temperature in a human hair area (4 to 1.5 cm over the scalp skin) is 25° to 28° C. The temperature of the hair dye composition is as high as the ambient temperature. The temperature in the hair area becomes 24.2° to 24.9° C. after the hair dye is applied on the hair. The tests conducted indicate that the temperature in the hair area would easily increase to 30° to 37° C. if a hand-held, hot-air blower was used to apply hot air to the dyed hair for three to give minutes after which a plastic, disposable, shower cap is placed around the head to retain the heat for the required time. The test indicated that the covered shower cap can maintain the temperature in the hair area between 29.5° to 31.5° C. for at least 30 minutes.

Alternatively, a plastic shower cap can be placed around the head after the hair dye is applied to the hair and then covered with a hot, moistened towel to apply heat to the hair. The towel was vetted with 50° to 55° C. warm water and then placed over the shower cap. With this alternative method, the temperature in the hair area inside the shower cap increased to 36° to 42° C. in 1 to 2 minutes. If the towel is removed but the shower cap is keep on, the temperature in the hair area can be maintained at 30° to 35° C. for at least 30 minutes.

Experiments confirm that a hair dyeing process utilizing a hair dye in combination with the above heat application means can attain the required hair color in a much shorter time than is possible with no heat applied. For example, at an ambient temperature of 20±2° C. the applicant's composition requires at least 30 minutes to dye the hair with a color intensity of 100, but it only needs 10 to 15 minutes to attain the same color intensity with the above mentioned heat application means.

EXAMPLE II

The following dye composition made by the applicant produces a bright burgundy color when applied to pre-bleached light-brown color hair:

| | |
|---|---|
| P-Phenylenediamine | 0.10% |
| p-Aminophenol | 0.12% |
| Ethanolamine | 1.5% |
| Hydrogen peroxide | 3% |
| Surfactant | 2.5% |
| Water | Q.S. 100% |

A specimen of pre-bleached, light brown color hair was treated with the above-described dye composition for 5, 10, 15, 20, 25 and 30 minutes in different temperatures. The test results for Example II follows:

| | time (minutes) | | | | | |
|---|---|---|---|---|---|---|
| | 5 min | 10 min | 15 min | 20 min | 25 min | 30 min |
| 20° C. color | 25 | 35 | 50 | 70 | 75 | 80 |
| 30° C. color | 50 | 80 | 85 | 90 | 95 | 100 |
| 40° C. color | 90 | 95 | 100 | 100 | 100 | 100 |

For the Example II composition, to attain a color intensity of 80 at 20° C. the hair dye must remain on the hair for a time period of 30 minutes, but at 40° C. a color intensity of 90 can be attained in 5 minutes.

In practice, at an ambient temperature 20° C.±2° C., the composition of Example II requires 40 minutes to dye the non-bleached hair from a dark color to the bright burgundy color. However, experiments indicate that the Example II composition can dye the non-bleached hair from a black color to a bright burgundy color in only 20 minutes, if the above heating process is applied.

EXAMPLE III

The same tests were performed with the hair dye products; 48 True red color may by Clairol, and RR04 dark red color may be L'Oreal, respectively.

Clairol advises that it may be necessary to leave the hair color on for a total of 30–45 minutes to dye the hair to the desired color. Experiments indicate that only 15–20 minutes is needed to dye the hair to the required color with the products made by Clairol and L'Oreal, if the above heating process is applied. As a result of the above example, it can be seen that the application of heat is an effective method for minimizing hair damage and improving the hair dyeing efficiency.

In the above examples, the coloring agents must be toxicologically and dermatologically suitable for such use, and they must achieve a coloring of the desired intensity. It is also necessary that when combining a developer and coupler components a broad color spectrum can be achieved. Further requirements include good tolerance to light, permanent wave treatments, acid and rubbing. The hair coloring should remain stable over a period of at least 4 to 6 weeks without negative influence from light, rubbing and chemical agents. Besides the three reactive components—primary dye intermediates, color couplers and oxidizers, an oxidative dye composition may contain thickening material, and reducing agents.

The composition can be thickened with, for example, sodium aliginate, gum arabic, cellulose derivatives such as methylcellulose, hydroxyethycellulose, htdrocypropylmethyclellose and carbocyethylcellulose, and various materials, such as oleyl alcohol, stearyl alcohol, cetyl alcohol, behenyl alcohol, and 1-docosanol.

The composition can contain anionic, cationic, non-ionic or amphoteri surface-active agents such as BRIJ56, BRIJ52, BRIJ58, Sodium Lauryl Sulfate and Cetrimonium Bromide.

The composition can contain, in association with the oxidation dyestuff precursors, couplers which are well known in the art. Couplers which can be used in the compositions include resorcinol and 2-methylresorcinol.

The composition can also contain reducing agents such as sodium sulfite, ascorbic acid and sodium bisulphite.

In view of the above, it is the primary objects of the invention to produce a process that when applied, in combination with one of the disclosed hair heating devices, allows hair to be efficiently dyed in a shorter time period which, in turn, mimimizes hair damage.

In addition to the primary object of the invention, it is also an object of the invention to provide a hair dyeing process and device that:

is quick and convenient, is relatively safe, can be used with a variety of hair color dyes, can be used with very little training, and is cost effective from both a manufacturing and consumer points of view.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
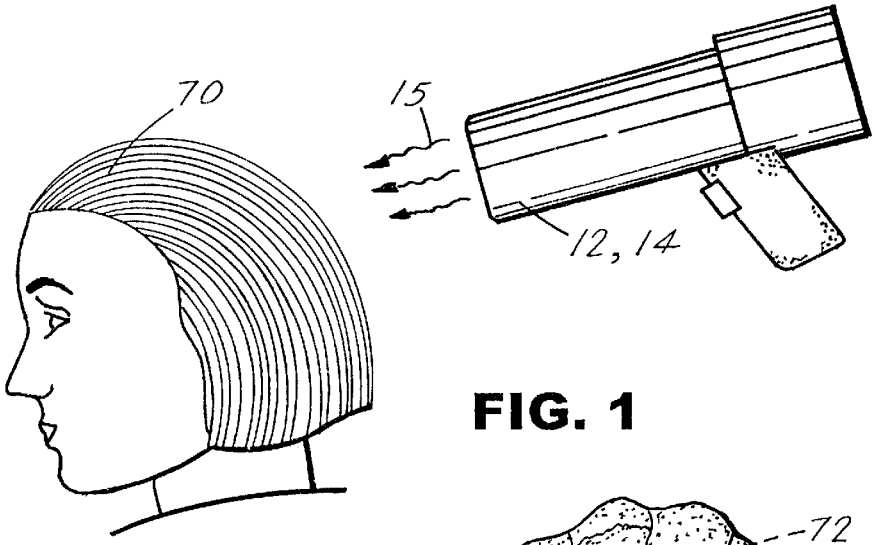
FIG. 1 is a side elevational view of a person having their hair dyed and the hair being subjected to a heat application means consisting of a hand-held, hot-air blower.

The best mode for carrying out the hair dyeing process is presented in terms of a preferred hair dyeing process which utilizes a hair dye in combination with a heat application means. The process minimizes hair damage and allows the hair to be efficiently dyed in a much shorter time period than is possible when using conventional hair dyeing processes.

The hair dyeing process is comprised of washing and drying the hair, applying the hair dye to the hair with a brush or other like implement, applying heat to the hair with a heat application means to expedite the hair dyeing process, removing the heat application means and ringing the hair with water.

Prior to commencing the above procedure, a skin test is recommended to detect any possible allergic reactions. To perform this test, a cotton swab is used to apply a small amount of the hair dye to a test area, preferably consisting of the inside surface of an elbow. Wait for a time period of 48 hours to see if any abnormal reaction occurs such as itching, swelling or redness around the test area. If an abnormal reaction occurs the hair dye should not be used.

the heat application means 12, as shown in FIGS. 1–7, is used in combination with the hair dye, and is disclosed in several design configurations that utilize the following major elements: a hand-held, hot-air blower 14, a plastic head cap 16, a table-top hot-air blower 28, a hot, moistened towel 32, a corded, electric heating pad 40 and a cordless heating pad 42.

Figure 2:
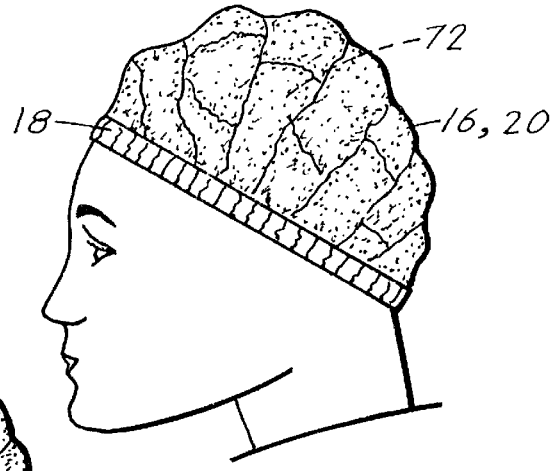
FIG. 2 is a side elevational view of a person having their hair dyed with the dyed hair, after the application of heat, having a cap placed over their head to enclose and retain the heat.

The first design configuration of the heat application means 12, as shown in FIGS. 1 and 2, utilizes the hand-held, hot-air blower 14. The hot air 15 is blown directly onto the dyed hair 70 for a period of three to four minutes. Immediately after the hair blowing has been completed, a towel or the plastic head cap 16 is attached around the head 72, as shown in FIG. 2, to enclose and retain the applied heat. The plastic head cap 16, which can consist of a disposable shower cap 20, preferably has a circumference to which is attached an elastic head band 18, as also shown in FIG. 2. The elastic head band 18 allows the head cap 16 to remain secured around the head 72.

Figure 3:
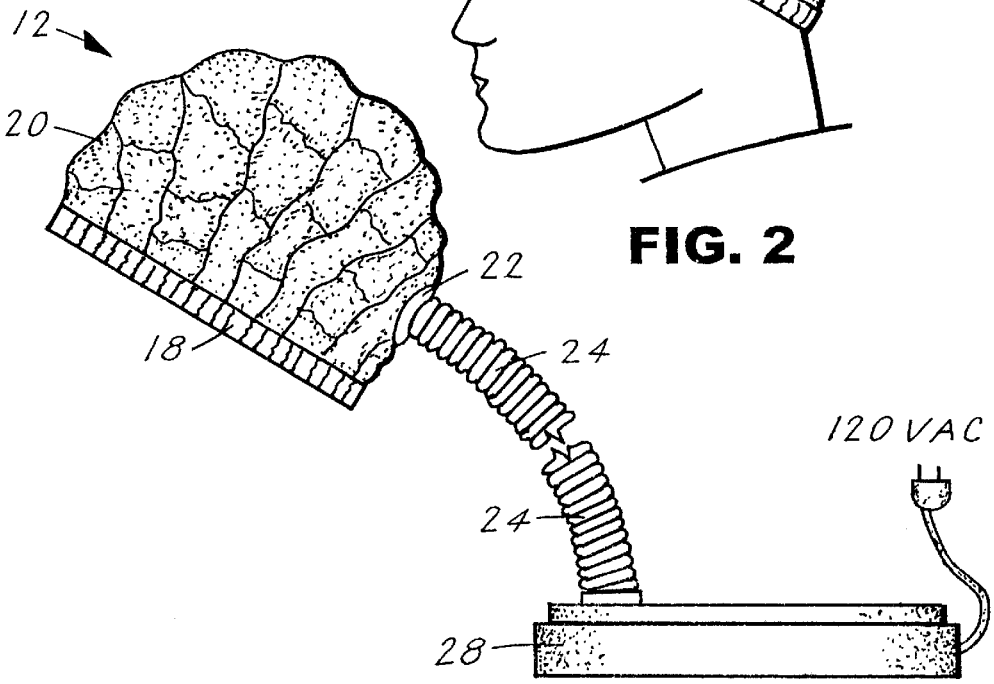
FIG. 3 is a side elevational view of a person having their hair dyed while wearing a head cap that is attached via a light, flexible hose to a table-top, hot-air blower which is blowing hot air over the dyed hair.

The second design configuration of the heat application means 12, as shown in FIG. 3, consists of the plastic head cap 16 that is secured around the head 22. The cap 16 includes an opening 22 that is connected via a light, flexible hose 24 to a heat source 26. The heat source 26 for this application consists of the table-top, hot-air blower 28, as shown in FIG. 3.

Figure 4:
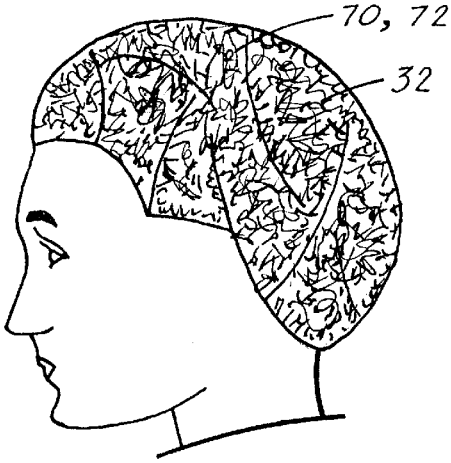
FIG. 4 is a side elevational view of a person having their hair dyed and with a hot, moistened towel placed over their head.
Figure 5:
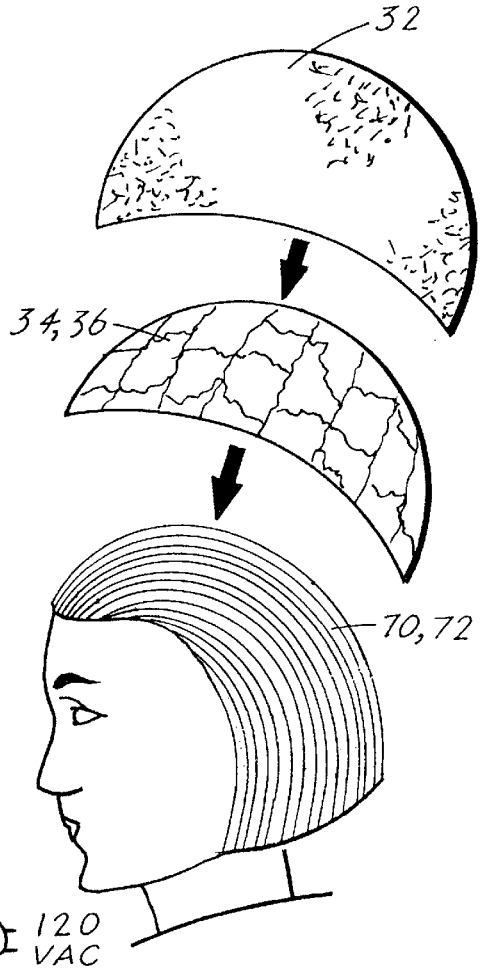
FIG. 5 is a side elevational view of a person having their hair dyed with aluminum foil or waxed paper placed over their head prior to applying a hot, moistened towel.

The third design configuration of the heat application means 12 consists simply of the hot, moistened towel 32 that is placed around the head 72, as shown in FIG. 4. To prevent or at least minimize soiling the towel 32, aluminum foil 34 or waxed paper 36 can be placed around the head 72, as shown in an exploded view of FIG. 5, prior to the placement of the towel. As with the first design configuration of the heat application means 12, a disposable shower cap 20 can be attached around the head 72 to enclose and retain the applied heat.

Figure 6:
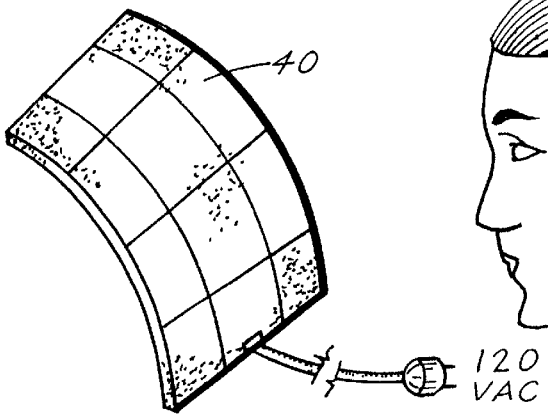
FIG. 6 is a perspective view of an electric heat pad, which can be utilized to apply heat to a person's head while having their hair dyed.

The fourth design configuration of the heat application means 12 consists of the corded, electric heating pad 40 that is positioned around the head 72, as shown in FIG. 6. Prior to positioning the pad 40, a pair of aluminum foil 34 or waxed paper 36 can be placed around the head 72 to prevent or at least minimize soiling the pad 40.

Figure 7:
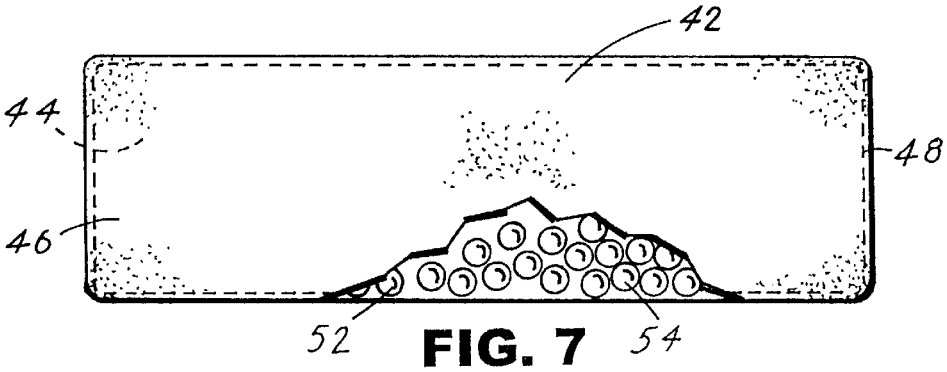
FIG. 7 is a plan view of a cordless heating pad, which can be utilized to apply head to a person's head while having their hair dyed. The cordless heating pad has inserted a multiplicity of heat absorbing elements, which retain heat when the pad is heated in a microwave oven.

The fifth design configuration of the heat application means 12 consists of the cordless heating pad 42. As shown in FIG. 7, the pad 42 consists of a lower section 44 that is attached to an upper section 46 by an attachment means 48 such as stitching. Inserted into the cordless heating pad 42 is a multiplicity of heat absorbing elements 58, which can consist of pig corn 52, a porous rock or the like. When the pad 42 is heated in a microwave oven, the heat absorbing elements 50 allow the pad 42 to retain heat for an extended period of time. Once heated, the pad 42 is positioned over the head 72, which is preferably covered with a piece of aluminum foil 34 or waxed paper 36 to prevent soiling the pad 42.

While the invention has been described in complete detail and pictorially shown in the accompanying drawings it is not to be limited to such details, since many changes and modifications may be made in the invention without departing from the spirit and scope thereof. For example, other heat application means 12 can be used. Hence, it is described to cover any and all modifications and forms which may come within the language and scope of the appended claims.

What is claimed is:

1. A hair dyeing process comprising the following steps:

a) apply a hair dye composition to the hair with a brush or other like implement, b) apply heat to the hair with a hand-held hot-air blower, wherein hot air is applied to the dyed hair for three to four minutes, after which a plastic head cap is immediately attached to the head to enclose, and retain the heat, c) remove the applied heat, and d) rinse the hair with water.

2. The process as specified in claim 1 wherein said plastic head cap having a circumference to which is attached an elastic head band which allows said head cap to remain secured around the head.

3. The process as specified in claim 2 wherein said plastic head cap is comprised of a disposable shower cap.

4. A hair dyeing process comprising the following steps:

a) apply a hair dye composition to the hair with a brush or other like implement, b) apply heat to the hair with a heat application means to expedite the hair dyeing process, wherein said heat application means comprises a plastic head cap that is secured around the head, and having an opening connected via a light flexible hose to a heat source, c) remove the heat application means, and d) rinse the hair with water.

5. A hair dyeing process comprising the following steps:

a) apply a hair dye composition to the hair with a brush or other like implement, b) apply an aluminum foil or waxed paper around the head, c) apply heat to the hair with a hand-held hot-air blower, wherein hot air is applied to the dyed hair for three to four minutes, after which a plastic head cap is immediately attached to the head to enclose, and retain the heat, d) remove the applied heat, and e) rinse the hair with water.

6. A hair dyeing process comprising the following steps:

a) apply a hair dye composition to the hair with a brush or other like implement, b) apply heat to the hair with a cordless heating pad having:

(1) a lower section, (2) an upper section attached to the lower section by an attachment means, and (3) a multiplicity of heat absorbing elements consisting of pig corn or porous rocks that are inserted into said cordless hot pad, wherein when said paid is heated in a microwave oven, wherein said pad expedites the hair dyeing process and retains heat for an extended period of time.

c) remove said cordless heating pad, and d) rinse the hair with water.

* * * * *